US009477197B1

(12) United States Patent
Mori et al.

(10) Patent No.: US 9,477,197 B1
(45) Date of Patent: Oct. 25, 2016

(54) SUPPORT MEMBER, IMAGE CARRIER, AND IMAGE FORMING APPARATUS

(71) Applicant: FUJI XEROX CO., LTD., Tokyo (JP)

(72) Inventors: Masahiro Mori, Kanagawa (JP); Hiroshi No, Kanagawa (JP); Shinya Makiura, Kanagawa (JP); Shuhei Yamazaki, Kanagawa (JP); Kazushi Arake, Kanagawa (JP); Satoshi Hayasaka, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/001,786

(22) Filed: Jan. 20, 2016

(30) Foreign Application Priority Data

Jul. 2, 2015 (JP) ..... 2015-133873

(51) Int. Cl.
*G03G 15/00* (2006.01)

(52) U.S. Cl.
CPC ..... *G03G 15/75* (2013.01); *G03G 15/751* (2013.01)

(58) Field of Classification Search
CPC ..... G03G 15/75; G03G 15/751
USPC ..... 399/116, 117, 159
See application file for complete search history.

(56) References Cited

U.S. PATENT DOCUMENTS

2002/0141781 A1* 10/2002 Litman ..... G03G 15/751 399/159

FOREIGN PATENT DOCUMENTS

JP H08-54804 A 2/1996

* cited by examiner

*Primary Examiner* — Hoang Ngo
(74) *Attorney, Agent, or Firm* — Oliff PLC

(57) ABSTRACT

A support member supported in a cylinder included in an image carrier includes a separation-space-defining portion that is arranged at a certain position in a circumferential direction and extends in an axial direction of the cylinder so that the support member has an arc shape; and a groove-defining portion that extends in the axial direction. An outer diameter of the support member in a central region in the axial direction is smaller than an outer diameter of the support member at both ends in the axial direction. In a state in which the support member is supported in the cylinder, the groove-defining portion is elastically deformed such that elastic restoring force generated in the central region is greater than elastic restoring force generated at the ends.

9 Claims, 11 Drawing Sheets

SUPPORT MEMBER, IMAGE CARRIER, AND IMAGE FORMING APPARATUS

CROSS-REFERENCE TO RELATED APPLICATIONS

This application is based on and claims priority under 35 USC 119 from Japanese Patent Application No. 2015-133873 filed Jul. 2, 2015.

BACKGROUND

1. Technical Field

The present invention relates to a support member, an image carrier, and an image forming apparatus.

2. Summary

According to an aspect of the invention, there is provided a support member supported in a cylinder included in an image carrier and includes a separation-space-defining portion that is arranged at a certain position in a circumferential direction and extends in an axial direction of the cylinder so that the support member has an arc shape; and a groove-defining portion that extends in the axial direction. An outer diameter of the support member in a central region in the axial direction is smaller than an outer diameter of the support member at both ends in the axial direction. In a state in which the support member is supported in the cylinder, the groove-defining portion is elastically deformed such that elastic restoring force generated in the central region is greater than elastic restoring force generated at the ends.

BRIEF DESCRIPTION OF THE DRAWINGS

Exemplary embodiments of the present invention will be described in detail based on the following figures, wherein.

DETAILED DESCRIPTION

First Exemplary Embodiment

Figure 1B:
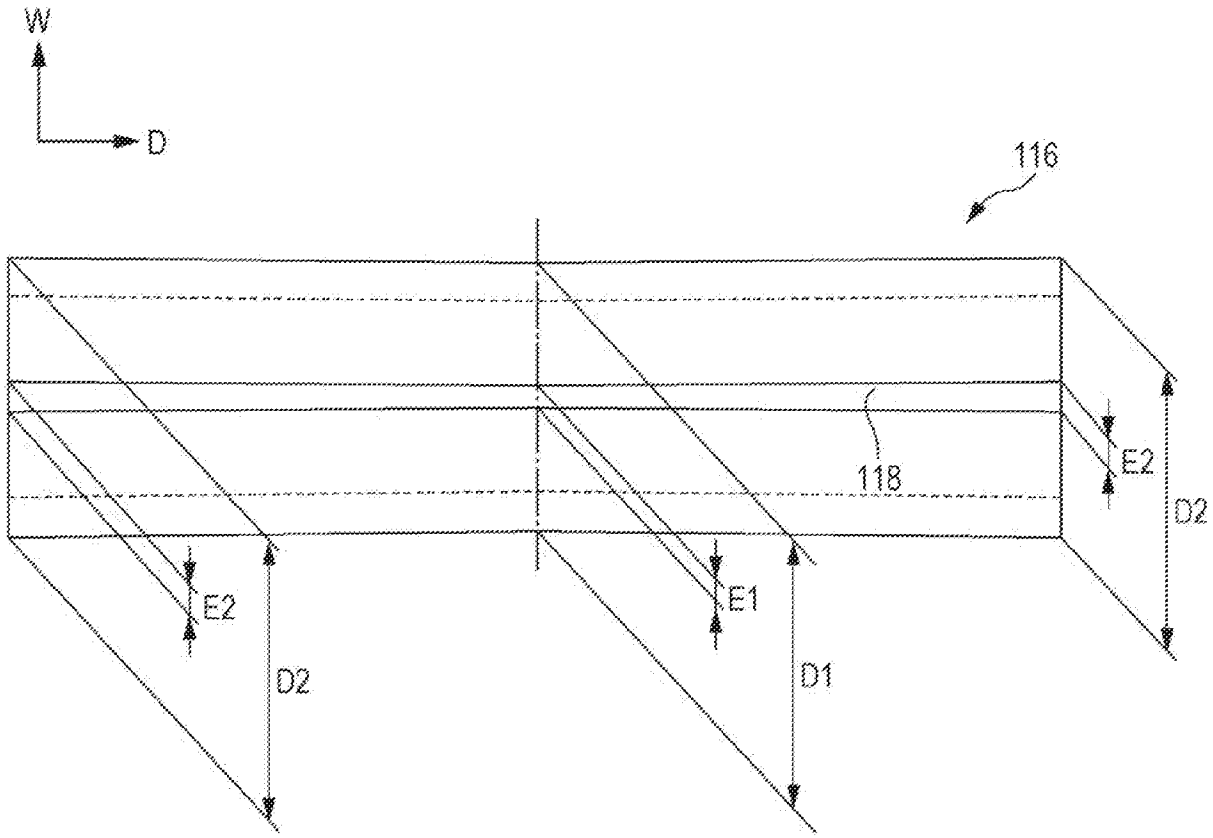
FIGS. 1A and 1B are a front view and a bottom view, respectively, of a support member according to a first exemplary embodiment of the present invention.
Figure 1A:
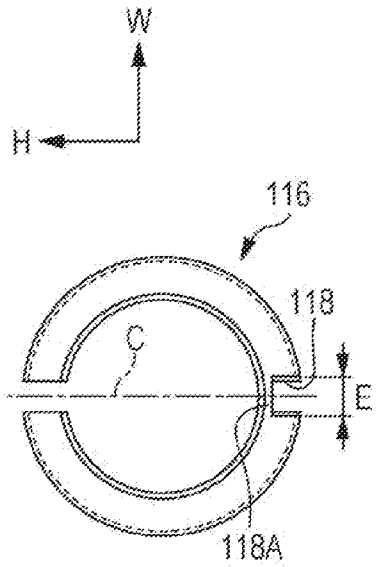

Examples of a support member, an image carrier, and an image forming apparatus according to a first exemplary embodiment of the present invention will be described with reference to FIGS. 1A to 9. In the drawings, the arrow H shows the up-down direction of the apparatus (vertical direction), the arrow W shows the width direction of the apparatus (horizontal direction), and the arrow D shows the depth direction of the apparatus (horizontal direction).

Overall Structure

Figure 7:
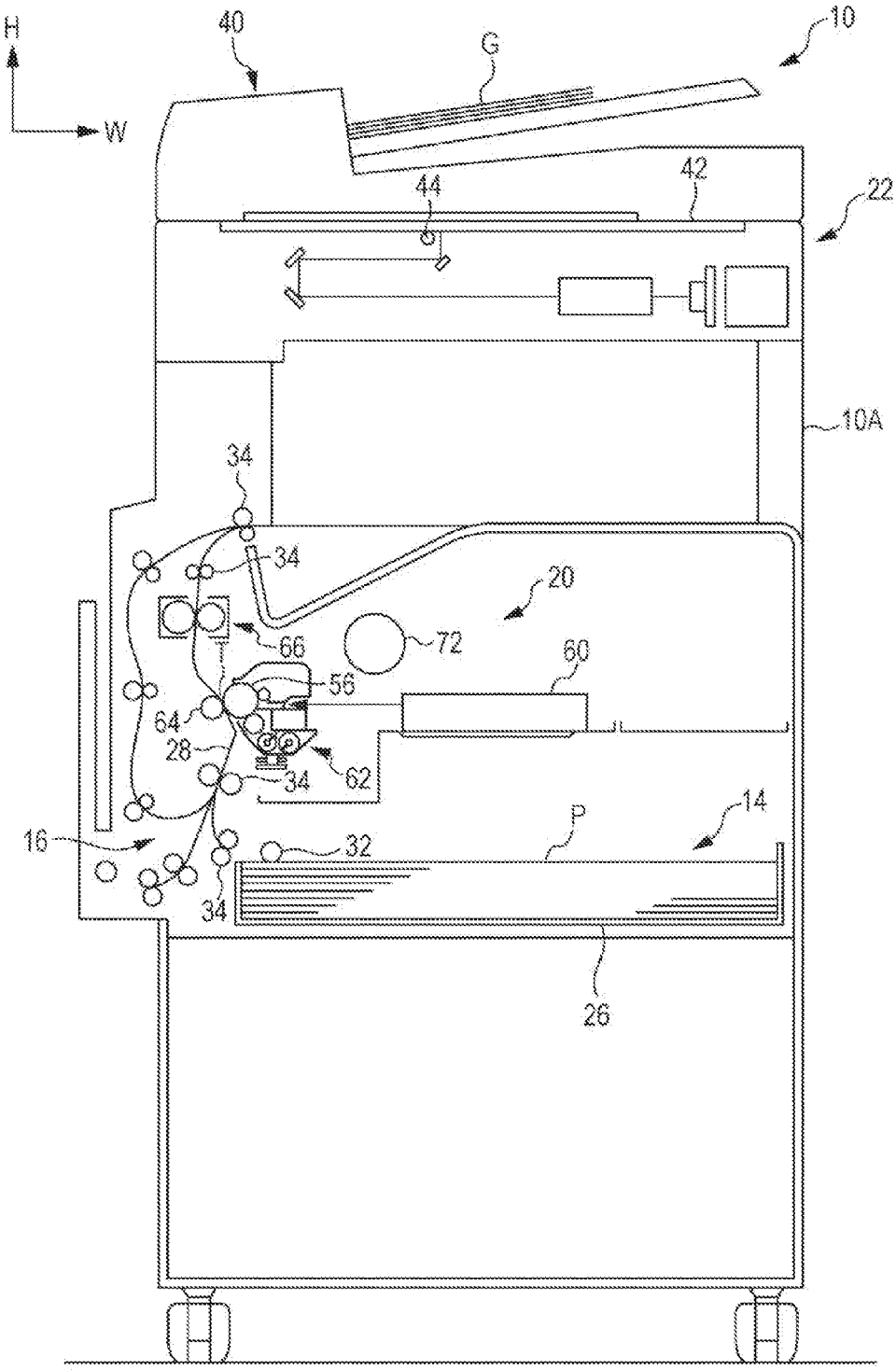
FIG. 7 is a schematic diagram illustrating the structure of the image forming apparatus according to the first exemplary embodiment of the present invention.

As illustrated in FIG. 7, an image forming apparatus 10 according to the present exemplary embodiment includes a container unit 14, a transport unit 16, an image forming unit 20, and a document reading unit 22, which are arranged in that order from the bottom to top in the up-down direction (direction of arrow H). The container unit 14 contains sheet materials P, which serve as recording media. The transport unit 16 transports the sheet materials P contained in the container unit 14. The image forming unit 20 forms images on the sheet materials P transported from the container unit 14 by the transport unit 16. The document reading unit 22 reads document sheets G.

Container Unit

The container unit 14 includes a container member 26 that may be pulled out from a body 10A of the image forming apparatus 10 toward the front side in the depth direction of the apparatus. The sheet materials P are stacked in the container member 26. The container unit 14 also includes a feed roller 32 that feeds the sheet materials P stacked in the container member 26 to a transport path 28 included in the transport unit 16.

Transport Unit

The transport unit 16 includes plural transport rollers 34 that transport sheet materials P along the transport path 28.

Document Reading Unit

The document reading unit 22 includes a light source 44 that emits light toward a document sheet G that has been transported by an automatic document transport device 40 or placed on a platen glass 42.

Image Forming Unit

Figure 6:
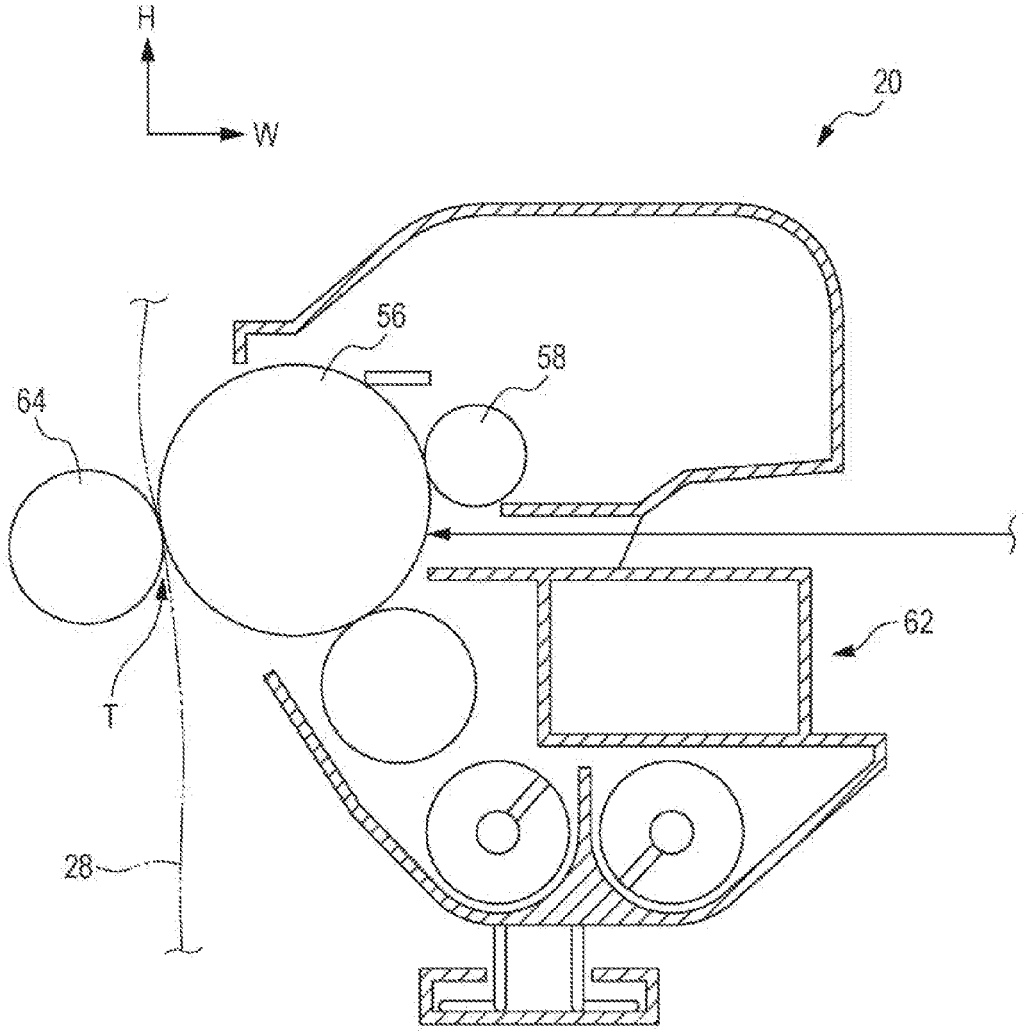
FIG. 6 illustrates the structure of an image forming unit included in an image forming apparatus according to the first exemplary embodiment of the present invention.

As illustrated in FIG. 6 the image forming unit 20 includes an image carrier 56 and a charging roller 58, which is an example of a charging device that charges a surface of the image carrier 56. The image forming unit 20 also includes an exposure device 60 (see FIG. 7) that irradiates the charged surface of the image carrier 56 with light on the basis of image data to form an electrostatic latent image, and a developing device 62 that visualizes the electrostatic latent image by developing the electrostatic latent image into a toner image.

The image forming unit 20 also includes a transfer roller 64 that transfers the toner image formed on the surface of the image carrier 56 onto the sheet material P that is transported along the transport path 28 at a transfer position T. The image forming unit 20 also includes a fixing device 66 (see FIG. 7) that fixes the toner image on the sheet material P to the sheet material P by applying heat and pressure.

The image carrier 56, the charging roller 58, etc., will be described in detail below.

Operation of Overall Structure

The image forming apparatus 10 forms an image by the following process.

First, a voltage is applied to the charging roller 58 that is in contact with the surface of the image carrier 56, so that the surface of the image carrier 56 is uniformly charged to a predetermined negative potential. Subsequently, the exposure device 60 irradiates the charged surface of the image carrier 56 with exposure light on the basis of image data read by the document reading unit 22 or data input from an external device, thereby forming an electrostatic latent image.

Thus, the electrostatic latent image corresponding to the image data is formed on the surface of the image carrier 56. The electrostatic latent image is visualized as a toner image by being developed by the developing device 62.

A sheet material P is fed from the container member 26 to the transport path 28 by the feed roller 32, and is transported toward the transfer position T at which the transfer roller 64 is in contact with the image carrier 56. The sheet material P is transported while being nipped between the image carrier 56 and the transfer roller 64 at the transfer position T, so that the toner image formed on the surface of the image carrier 56 is transferred onto the sheet material P.

The toner image that has been transferred onto the sheet material P is fixed to the sheet material P by the fixing device 66. The sheet material P to which the toner image has been fixed is transported to the outside of the body 10A by the transport rollers 34.

Structure of Components

The image carrier 56, the charging roller 58, etc., will now be described.

Charging Roller

Figure 5:
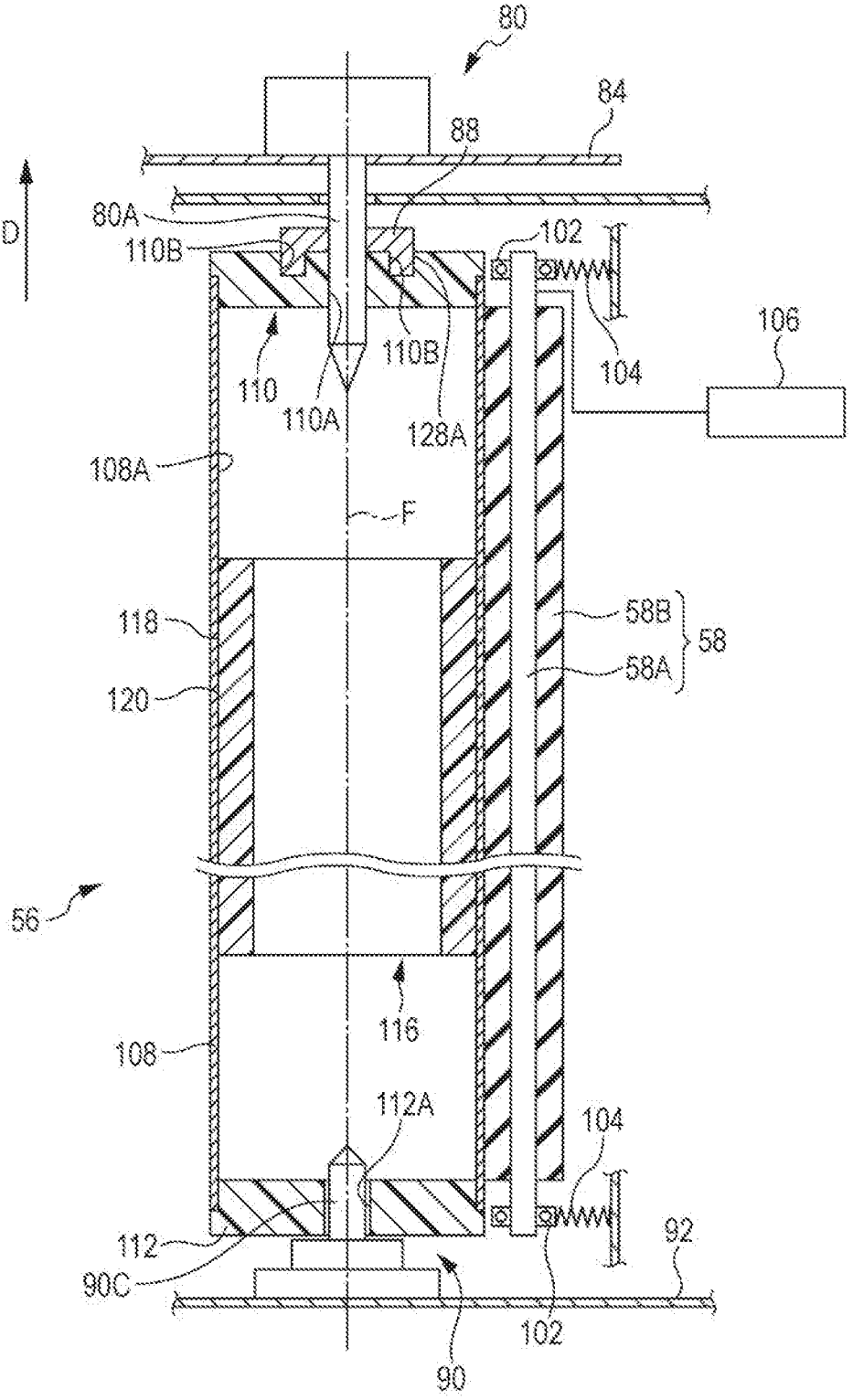
FIG. 5 is a sectional view of an image carrier and other components according to the first exemplary embodiment of the present invention.

As illustrated in FIG. 5 the charging roller 58 includes a shaft 58A that extends in the depth direction of the apparatus and that is made of a metal material (for example, a stainless steel), and a roller portion 58B that has a cylindrical shape through which the shaft 58A extends and that is made of a rubber material.

Both ends of the shaft 58A project outward from the roller portion 58B, and are rotatably supported by a pair of bearings 102. Urging members 104 that urge the bearings 102 toward the image carrier 56 are arranged so as to face the image carrier 56 with the shaft 58A disposed therebetween. With this structure, the roller portion 58B of the charging roller 58 is pressed against the image carrier 56. Accordingly, when the image carrier 56 rotates, the charging roller 58 is rotated by the image carrier 56.

A superposed voltage, in which a direct-current voltage and an alternating-current voltage are superposed, is applied to the shaft 58A by a power supply 106.

Image Carrier

As illustrated in FIG. 5, the image carrier 56 includes a cylinder 108 that has a cylindrical shape and extends in the depth direction of the apparatus, and a transmission member 110 that is fixed to the cylinder 108 at a first end (upper end in FIG. 5) of the cylinder 108 in the depth direction of the apparatus (direction similar to the axial direction of the cylinder 108). The image carrier 56 also includes a base member 112 that is fixed to the cylinder 108 at a second end (lower end in FIG. 5) of the cylinder 108 in the depth direction of the apparatus. The image carrier 56 further includes a support member 116 disposed in the cylinder 108 to suppress vibration of the surface of the cylinder 108.

The cylinder 108 is formed by forming a photosensitive layer on an outer surface of a cylindrical base made of a metal material. In the present exemplary embodiment, the base of the cylinder 108 is an aluminum tube, and the thickness of the cylinder 108 is 1.0 [mm]. The outer diameter of the cylinder 108 is 30 [mm], and the length of the cylinder 108 in the depth direction of the apparatus is 340 [mm].

The transmission member 110 is made of a resin material and is disc-shaped. A portion of the transmission member 110 is fitted to the cylinder 108 so that the transmission member 110 is fixed to the cylinder 108 and seals the opening of the cylinder 108 at the first end of the cylinder 108. A columnar through hole 110A that extends along the axial center F of the cylinder 108 is formed in the transmission member 110. Plural recesses 110B are formed in an outer surface of the transmission member 110 that faces outward in the depth direction of the apparatus. The recesses 110B are positioned such that the through hole 110A is disposed therebetween.

The base member 112 is made of a resin material and is disc-shaped. A portion of the base member 112 is fitted to the cylinder 108 so that the base member 112 is fixed to the cylinder 108 and seals the opening of the cylinder 108 at the second end of the cylinder 108. A columnar through hole 112A that extends along the axial center F of the cylinder 108 is formed in the base member 112. The support member 116 will be described in detail below.

Others

As illustrated in FIG. 5, a motor 80 that generates a rotating force to be transmitted to the image carrier 56 (transmission member 110) is disposed near a first end of the image carrier 56 in the depth direction of the apparatus.

The motor 80 is attached to a plate-shaped frame 84. The motor 80 has a motor shaft 80A that extends through the through hole 110A formed in the transmission member 110. A plate-shaped bracket 88 is fixed to the outer peripheral surface of the motor shaft 80A. The bracket 88 has end portions that are bent and inserted into the recesses 110B in the transmission member 110. Thus, the transmission member 110 transmits the rotating force generated by the motor 80 to the cylinder 108.

A stepped columnar shaft member 90 that supports the image carrier 56 (base member 112) in a rotatable manner is disposed at a second end of the image carrier 56 in the depth direction of the apparatus. The shaft member 90 is attached to a plate-shaped frame 92.

The shaft member 90 includes a shaft portion 90C that extends through the columnar through hole 112A of the base member 112 along the axial center F of the cylinder 108. A hollow space is provided between the inner peripheral surface of the columnar through hole 112A and the outer peripheral surface of the shaft portion 90C. Thus, the base member 112 functions as a so-called sliding bearing for the shaft portion 90C.

In this structure, when the motor 80 is activated, the motor shaft 80A rotates. The rotation of the motor shaft 80A is transmitted to the cylinder 108 through the bracket 88 and the transmission member 110 fixed to the first end of the cylinder 108. Accordingly, the base member 112 fixed to the second end of the cylinder 108 rotates around the shaft portion 90C. Thus, the image carrier 56 rotates around the axial center F.

Support Member

The support member 116 supported in the cylinder 108 will now be described.

As illustrated in FIG. 5, the support member 116 is fitted to the cylinder 108 and arranged in a central region of the cylinder 108 in the depth direction of the apparatus. As illustrated in FIG. 3B, an arc-shaped outer peripheral surface 120 of the support member 116 is in contact with an inner peripheral surface 108A of the cylinder 108 and presses the inner peripheral surface 108A, so that the support member 116 is supported by the cylinder 108.

More specifically, the support member 116 is made of an acrylonitrile-butadiene-styrene (ABS) resin, which is a resin material. In the state in which the support member 116 is supported in the cylinder 108, when viewed in the depth direction of the apparatus, the support member 116 is C-shaped (arc-shaped) such that end portions thereof oppose each other along the inner peripheral surface 108A of the cylinder 108. The space between the opposing end portions serve as a separation space 116A that separates the end portions in the circumferential direction. The separation space 116A corresponds to a separation-space-defining portion. In addition, as illustrated in FIG. 4, the support member 116 extends in the depth direction of the apparatus. In the first exemplary embodiment, for example, the thickness of a general portion of the support member 116 (thickness T1 in FIG. 3A) is 4 [mm], and the length of the support member 116 in the depth direction of the apparatus is 100 [mm].

As illustrated in FIG. 3B, in the state in which the support member 116 is supported in the cylinder 108, a groove-defining portion 118, which extends in the depth direction of the apparatus, is formed in the outer peripheral surface 120 of the support member 116 at a side opposite to the side at which the separation space 116A is provided with the axial center F of the cylinder 108 provided therebetween. The groove-defining portion 118 extends from one end to the other end of the support member 116 in the depth direction of the apparatus.

Figure 3A:
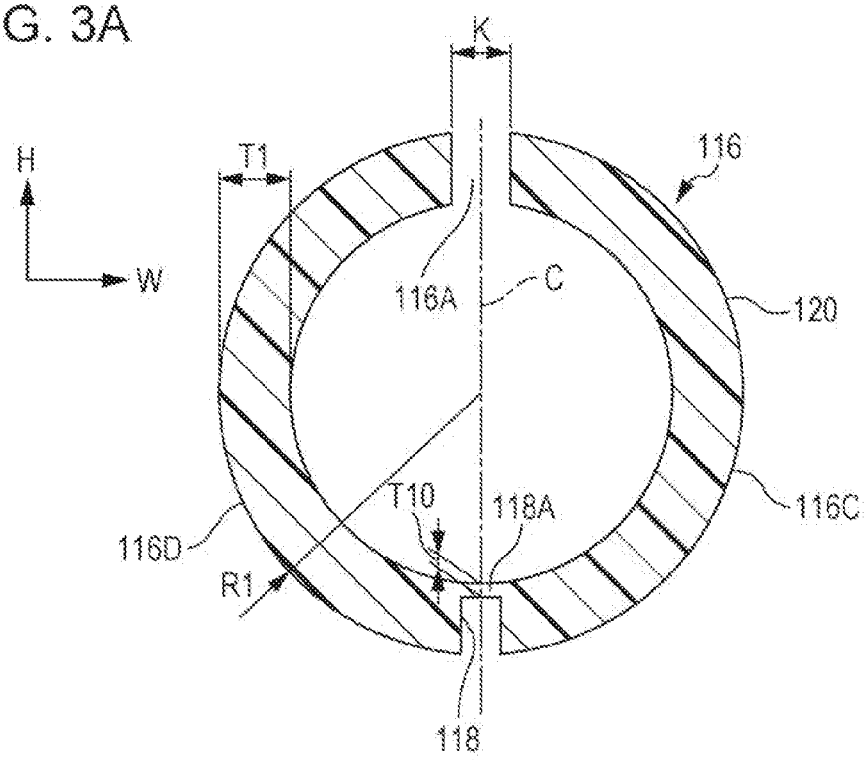
FIGS. 3A and 3B are sectional views of the support member according to the first exemplary embodiment of the present invention.
Figure 3B:
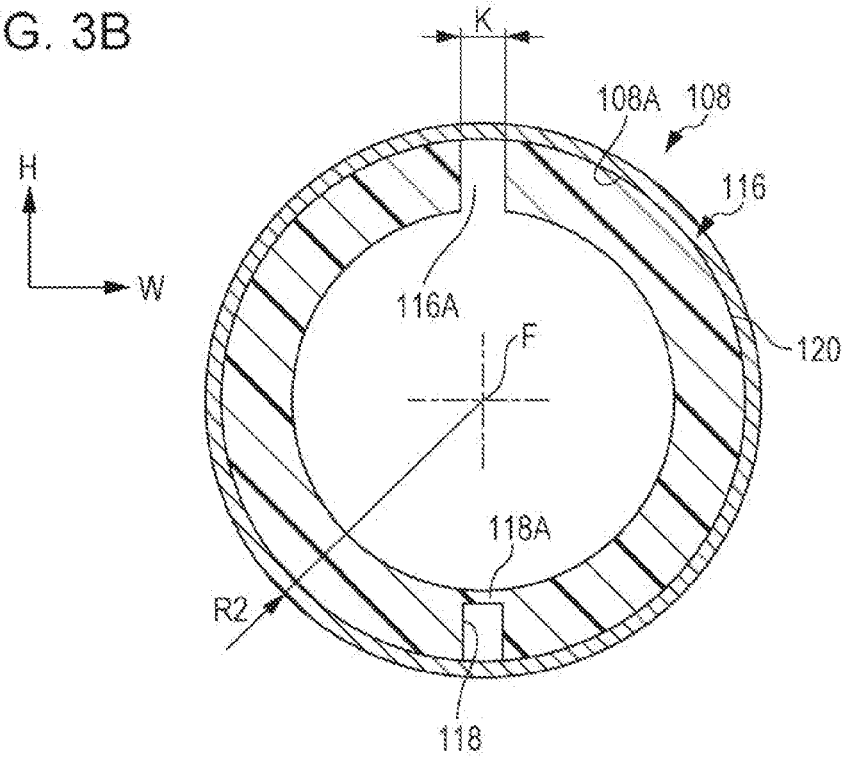
Figure 4:
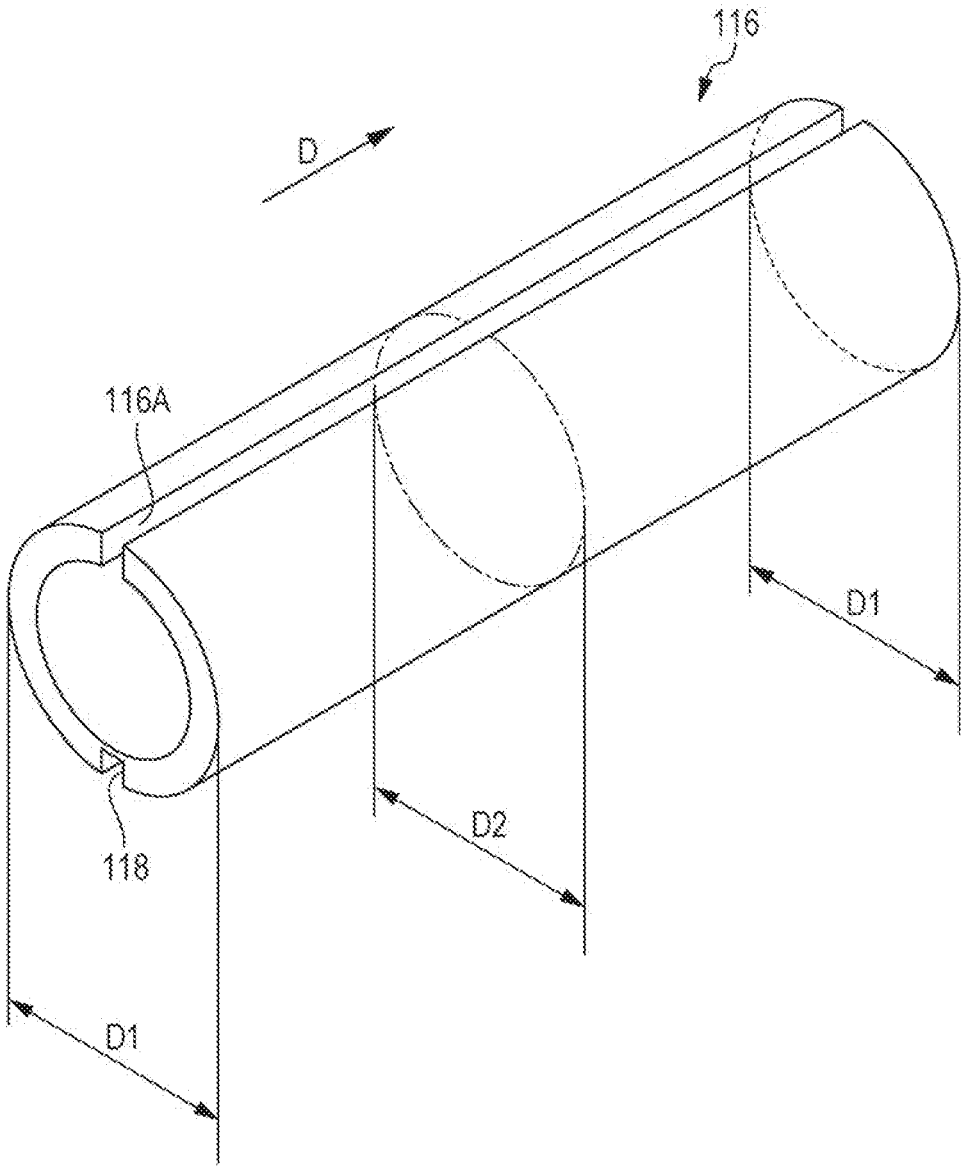
FIG. 4 is a perspective view of the support member according to the first exemplary embodiment of the present invention.

As illustrated in FIG. 3A, in the state in which the support member 116 is not supported in the cylinder 108, that is, when the support member 116 is in a free state, the support member 116 is symmetrical about the line C that passes through the separation space 116A and the groove-defining portion 118 when viewed in the depth direction of the apparatus.

More specifically, the support member 116 is shaped such that an arc-shaped portion 116C at the right side in FIG. 3A and an arc-shaped portion 116D at the left side in FIG. 3A are connected together by a bottom plate 118A of the groove-defining portion 118. The radius R1 of the outer peripheral surface 120 of the arc-shaped portions 116C and 116D of the support member 116 in the free state is greater than or equal to the radius R2 of the inner peripheral surface 108A of the cylinder 108 (see FIG. 3B).

A gap distance K of the separation space 116A of the support member 116 in the free state (see FIG. 3A) is greater than that in the state in which the support member 116 is supported in the cylinder 108 (see FIG. 3B).

When the support member 116 is in the free state, the outer diameter of the support member 116 in the central region in the depth direction of the apparatus (outer diameter D1 in FIGS. 1B and 4) is smaller than the outer diameter of the support member 116 at the ends in the depth direction of the apparatus, that is, that outer diameter of both end portions in the present exemplary embodiment (outer diameter D2 in FIGS. 1B and 4). In the present exemplary embodiment, the outer diameter D1 is smaller than the outer diameter D2 by, for example, about 0.2 [mm].

The outer diameter is the maximum dimension in the direction perpendicular to the line C that passes through the separation space 116A and the groove-defining portion 118 when viewed in the depth direction of the apparatus.

Figure 2A:
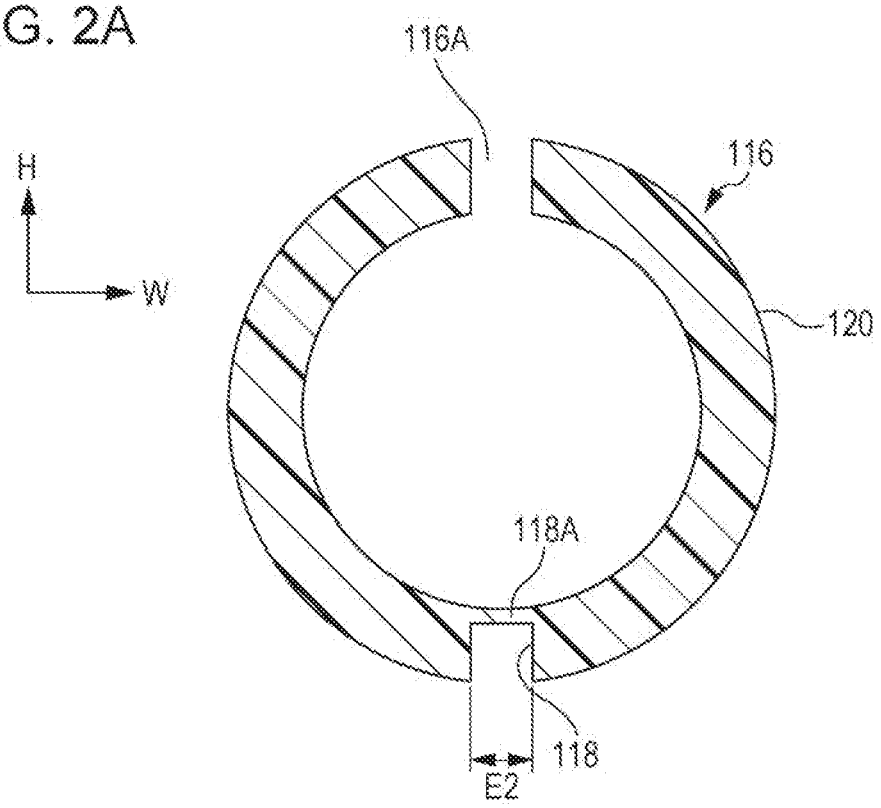
FIGS. 2A and 2B are sectional views of the support member according to the first exemplary embodiment of the present invention.
Figure 2B:
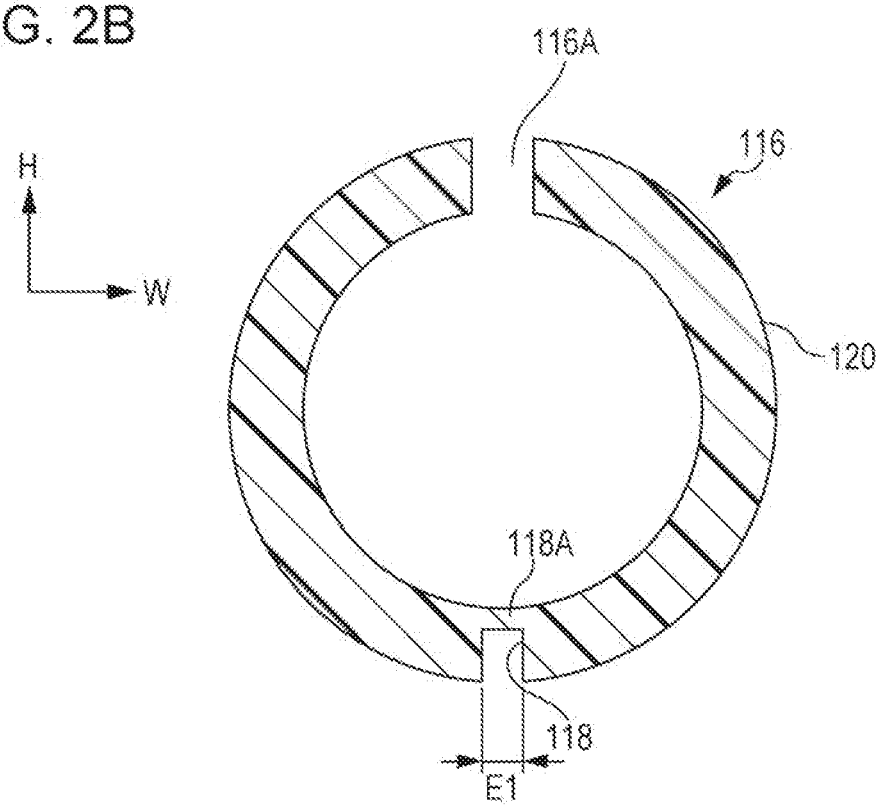

In addition, as illustrated in FIG. 1B, the groove width of the groove-defining portion 118 (groove width E in FIG. 1A) is set such that the groove width in the central region in depth direction of the apparatus (groove width E1 in FIGS. 1B and 2B) is smaller than the groove width at the ends in the depth direction of the apparatus (groove width E2 in FIGS. 1B and 2A). In other words, the plate width of the bottom plate 118A of the groove-defining portion 118 in the central region in the depth direction of the apparatus is smaller than the plate width at the ends in the depth direction of the apparatus.

In the first exemplary embodiment, for example, the groove width E2 and the groove depth at both ends in the depth direction of the apparatus are set to 4 [mm] and 3 [mm], respectively, and the groove width E1 and the groove depth in the central region are set to 3.6 [mm] and 3 [mm], respectively.

The plate thickness of the bottom plate 118A (T10 in FIG. 3A) is constant in the depth direction of the apparatus.

With this structure, when the support member 116 is supported in the cylinder 108 such that the bottom plate 118A of the groove-defining portion 118 is elastically deformed, the elastic restoring force generated by the bottom plate 118A in the central region in the depth direction of the apparatus is greater than the elastic restoring force generated by the bottom plate 118A at both ends in the depth direction of the apparatus. This will be described in more detail below.

Effects

The effects of the support member 116 in the process of arranging the support member 116 such that the support member 116 is supported in the cylinder 108 will now be described.

To arrange the support member 116 such that the support member 116 is supported in the cylinder 108, the support member 116 is retained such that the bottom plate 118A of the groove-defining portion 118 is elastically deformed so as to reduce the gap distance K. Thus, the support member 116 is bent. The support member 116 retained in the bent state is inserted into the cylinder 108. Then, the retaining force applied to the support member 116 is removed. When the retaining force is removed, the elastically deformed bottom plate 118A exerts an elastic restoring force so that the outer peripheral surface 120 of the support member 116 presses the inner peripheral surface 108A of the cylinder 108. In this state, the support member 116 is pushed toward the central region of the cylinder 108.

Accordingly, the outer peripheral surface 120 of the support member 116 is in contact with the inner peripheral surface of the cylinder 108 and presses the inner peripheral surface 108A over a region extending in the depth direction of the apparatus (axial direction of the cylinder 108). In this manner, the support member 116 is supported in the cylinder 108.

The effects of the support member 116 will be described from the viewpoint of reduction of vibration of the cylinder 108 due to the support member 116.

To charge the surface of the image carrier 56, the power supply 106 applies a superposed voltage, in which a direct-current voltage and an alternating-current voltage (1 to 2 kHz) are superposed, to the shaft 58A of the charging roller 58 (see FIG. 5). Owing to the alternating-current voltage included in the superposed voltage, an alternating electric field is generated between the charging roller 58 and the image carrier 56. Accordingly, a periodic electrostatic attraction force (2 to 4 kHz) is generated between the image carrier 56 and the charging roller 58. As a result, the cylinder 108 receives a force that periodically changes the cross-sectional shape of the cylinder 108 or vibrates the cylinder 108.

However, the support member 116, which has the outer peripheral surface 120 that presses the inner peripheral surface 108A of the cylinder 108, is supported in the cylinder 108. More specifically, the outer peripheral surface 120 of the support member 116 is in contact with the inner peripheral surface 108A of the cylinder 108 and presses the inner peripheral surface 108A over a region extending in the depth direction of the apparatus (axial direction of the cylinder 108). Accordingly, vibration of the cylinder 108 is reduced even when the force that periodically changes the cross-sectional shape of the cylinder 108 is applied to the cylinder 108.

The effects of the support member 116 will be further described by comparing the support member 116 with a support member 310 of a comparative example in terms of the pressing force applied by the outer peripheral surface 120 of the support member 116 to the inner peripheral surface 108A of the cylinder 108.

First, the support member 310 according to the comparative example will be described. Components of the support member 310 that differ from those of the support member 116 will be mainly described.

Figure 8B:
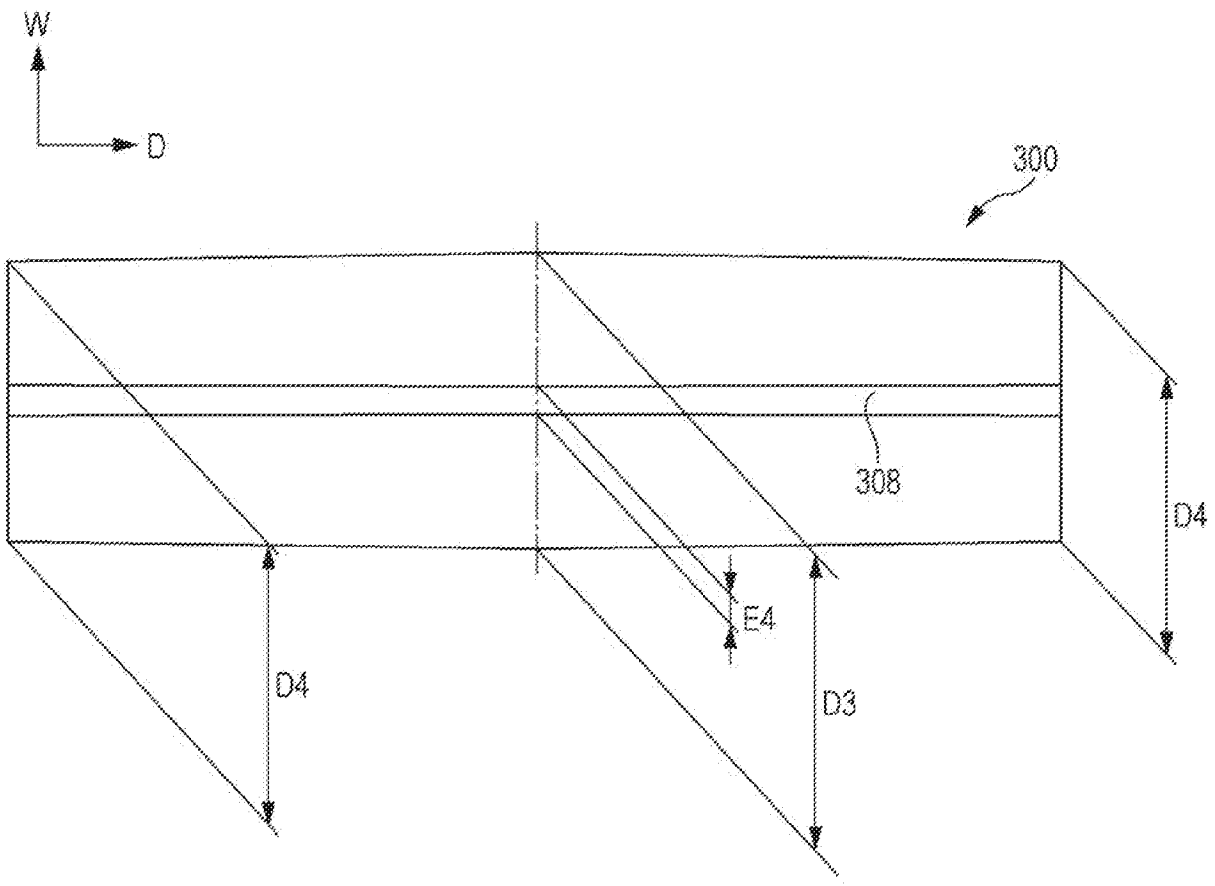
FIGS. 8A and 8B are a front view and a bottom view, respectively, of a support member according to a comparative example to be compared with the support member according to the first exemplary embodiment of the present invention.
Figure 9B:
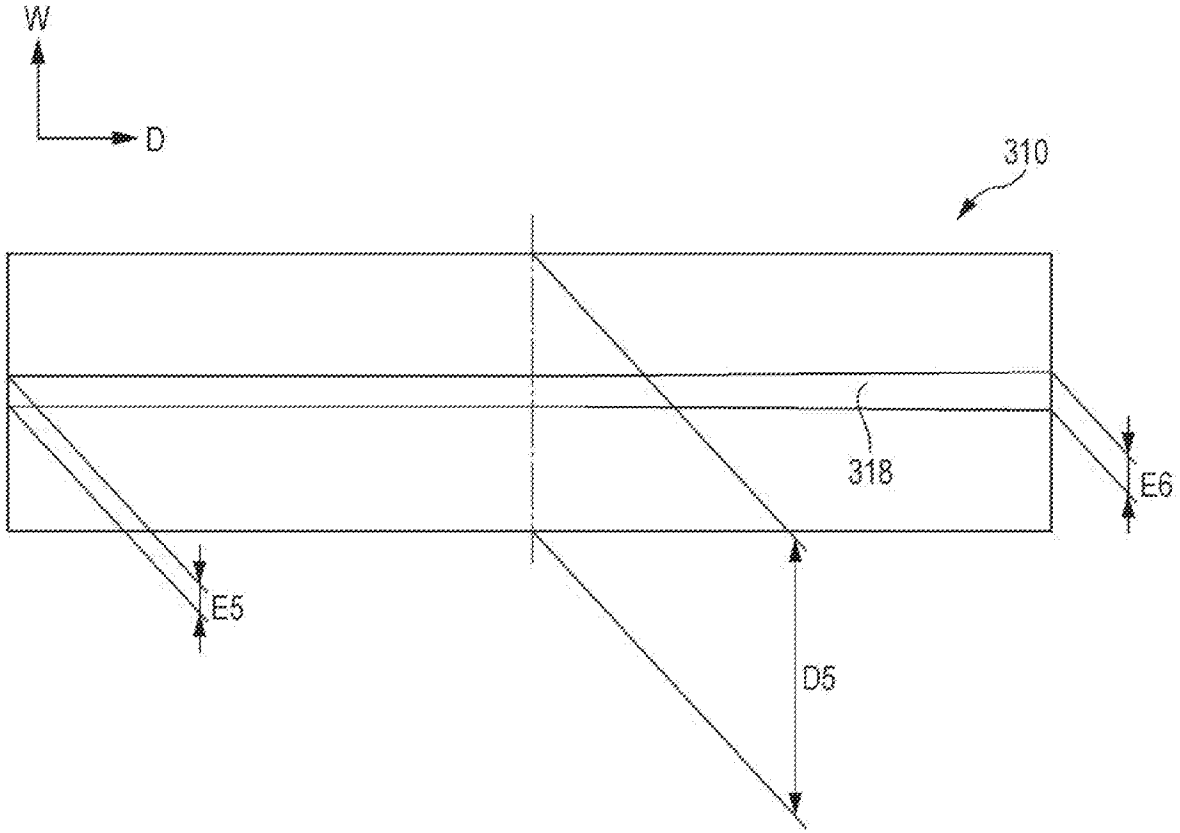
FIGS. 9A and 9B are a front view and a bottom view, respectively, of a support member according to another comparative example to be compared with the support member according to the first exemplary embodiment of the present invention.
Figure 9A:
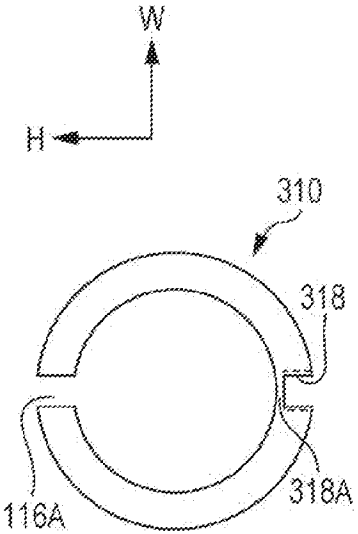

As illustrated in FIGS. 9A and 9B, when the support member 310 is in a free state, the outer diameter of the support member 310 (outer diameter D5 in FIG. 8B) is constant in the depth direction of the apparatus.

The groove width E5 of a portion of a groove-defining portion 318 of the support member 310 at one side in the depth direction of the apparatus (left side in FIG. 9B) is smaller than the groove width E6 of a portion of the groove-defining portion 318 at the other side in the depth direction of the apparatus (right side in FIG. 9B).

The support member 310 is designed so as to have a uniform cross section in the longitudinal direction. However, because of the manufacturing differences, the groove width E5 at one side in the depth direction of the apparatus is smaller than the groove width E6 at the other side in the depth direction of the apparatus.

Therefore, in the state in which a bottom plate 318A of the groove-defining portion 318 is elastically deformed so as to reduce the gap distance K, the elastic restoring force generated by the bottom plate 318A at one side in the depth direction of the apparatus is greater than the elastic restoring force generated by the bottom plate 318A at the other side in the depth direction of the apparatus. Accordingly, there is a risk that the outer peripheral surface 120 cannot sufficiently press the inner peripheral surface 108A of the cylinder 108 to suppress vibration of the cylinder 108 at the other side in the depth direction of the apparatus.

In contrast, as illustrated in FIG. 1B, in the support member 116, the groove width E1 in the central region in the depth direction of the apparatus is smaller than the groove width E2 at both ends in the depth direction of the apparatus. In the state in which the bottom plate 118A is elastically deformed so as to reduce the gap distance K, the elastic restoring force generated by the bottom plate 118A in the central region in the depth direction of the apparatus is greater than the elastic restoring force generated by the bottom plate 118A at both ends in the depth direction of the apparatus.

Accordingly, unlike the case in which the support member 310 is used, when the support member 116 is supported in the cylinder 108, the support member 116 exerts similar pressing forces at both ends in the depth direction of the apparatus.

Next, the support member 116 will be compared with a support member 300 according to another comparative example in terms of the position of the support member 116 when the support member 116 is supported in the cylinder 108.

First, the support member 300 according to the comparative example will be described. Components of the support member 300 that differ from those of the support member 116 will be mainly described.

Figure 8A:
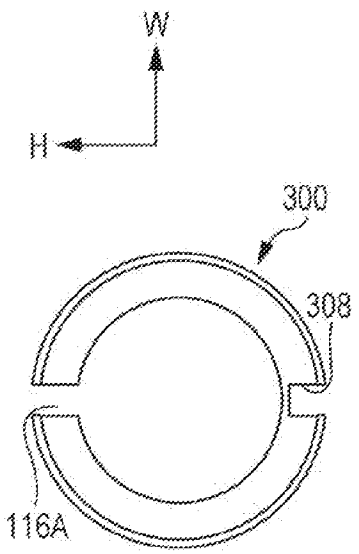

As illustrated in FIGS. 8A and 8B, when the support member 300 is in the free state, the outer diameter of the support member 300 in the central region in the depth direction of the apparatus (outer diameter D3 in FIG. 8B) is greater than the outer diameter of the support member 300 at both ends in the depth direction of the apparatus (outer diameter D4 in FIG. 8B).

The support member 300 is designed so as to have a uniform cross section in the longitudinal direction. However, because of the manufacturing differences, the outer diameter in the central region in the depth direction of the apparatus (axial direction) is greater than the outer diameter at both ends in the depth direction of the apparatus. Accordingly, there is a risk that the outer peripheral surface 120 cannot sufficiently press the inner peripheral surface 108A of the cylinder 108 to suppress vibration of the cylinder 108 at both ends in the depth direction of the apparatus.

The support member 300 includes a groove-defining portion 308 having a groove width E4 that is constant in the depth direction of the apparatus.

As illustrated in FIG. 1B, the outer diameter D1 of the support member 116 in the central region in the depth direction of the apparatus is smaller than the outer diameter D2 of the support member 116 at both ends in the depth direction of the apparatus.

Accordingly, unlike the case in which the support member 300 is used, when the support member 116 is supported in the cylinder 108, the support member 116 presses the inner peripheral surface 108A of the cylinder 108 more strongly at both ends in the depth direction of the apparatus than in the central region in the depth direction of the apparatus. Therefore, the support member 116 may be supported in the cylinder 108 in a more stable position than in the case where the support member 300 is used.

Summary

As described above, unlike the case in which the support member 310 is used, when the support member 116 is supported in the cylinder 108, the support member 116 exerts similar pressing forces at both ends thereof in the depth direction of the apparatus. In addition, the support member 116 may be supported in the cylinder 108 in a more stable position than in the case where the support member 300 is used.

Accordingly, when the support member 116 is used, vibration of the cylinder 108 may be further reduced than in the case where the support members 300 and 310 are used.

Since the vibration of the cylinder 108 included in the image carrier 56 is reduced, reduction in the quality of the toner image formed on the image carrier 56 may be suppressed.

Furthermore, since reduction in the quality of the toner image formed on the image carrier 56 is suppressed, reduction in the quality of the image output by the image forming apparatus 10 may be suppressed accordingly.

In addition, in the image forming apparatus 10, since vibration of the cylinder 108 is reduced, high frequency noise generated by surface vibration of the cylinder 108 may also be reduced.

Second Exemplary Embodiment

A support member, an image carrier, and an image forming apparatus according to a second exemplary embodiment of the present invention will be described with reference to FIGS. 10A, 10B, 11A, and 11B. Components that are the same as those in the first exemplary embodiment are denoted by the same reference numerals, and descriptions thereof are omitted. Components that are different from those in the first exemplary embodiment will be mainly described.

Figures 10A, 10B:
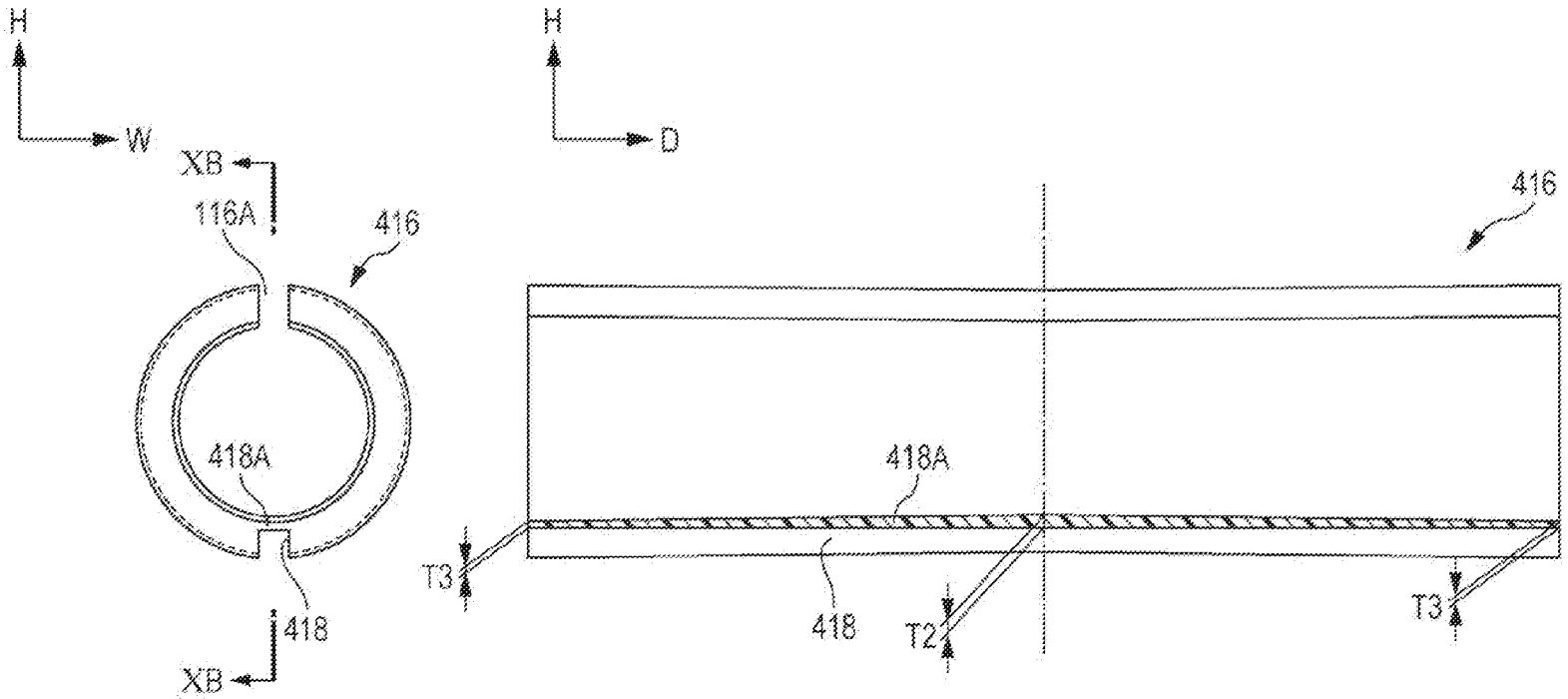
FIG. 10A is a front view of a support member according to a second exemplary embodiment of the present invention.
FIG. 10B is a sectional view taken along line XB-XB in FIG. 10A.
Figure 11A:
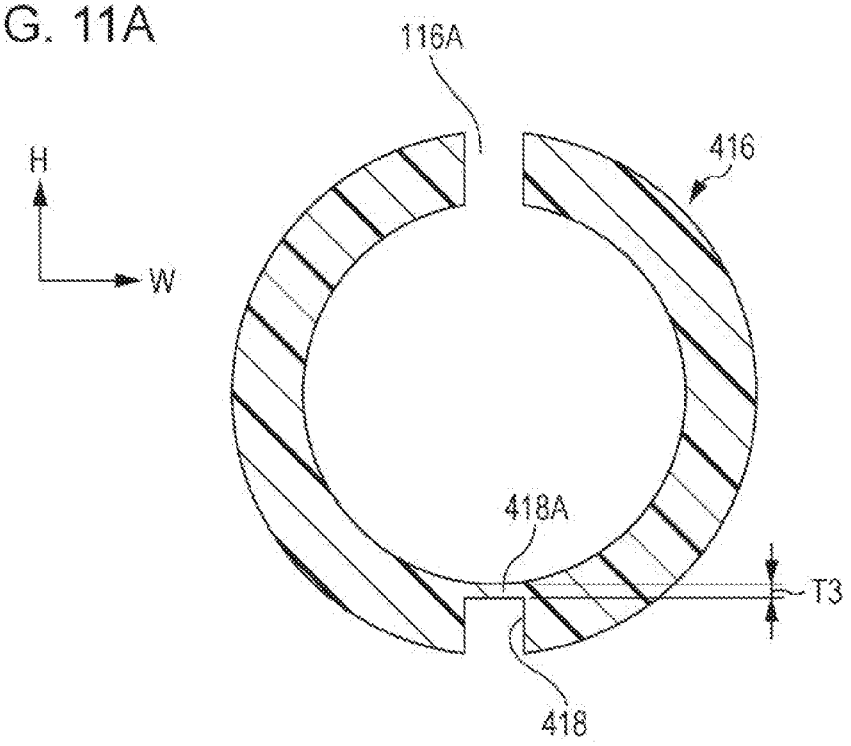
FIGS. 11A and 11B are sectional views of the support member according to the second exemplary embodiment of the present invention.
Figure 11B:
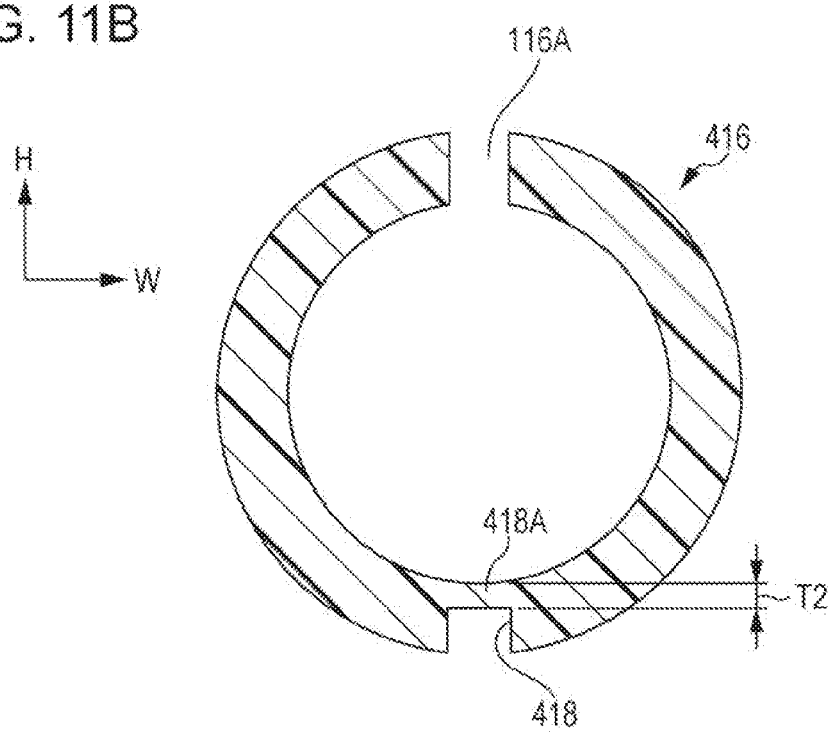

A groove-defining portion 418 of a support member 416 according to the second exemplary embodiment has a constant groove width in the depth direction of the apparatus. As illustrated in FIGS. 10B, 11A, and 11B, the thickness of a bottom plate 418A of the groove-defining portion 418 in central region in the depth direction of the apparatus (plate thickness T2 in FIGS. 10A, 10B, 11A, and 11B) is greater than the thickness of the bottom plate 418A of the groove-defining portion 418 at the ends in the depth direction of the apparatus (plate thickness T3 in FIGS. 10A, 10B, 11A, and 11B).

Accordingly, in the state in which the support member 416 is supported in the cylinder 108, the elastic restoring force generated by the bottom plate 418A in the central region in the depth direction of the apparatus is greater than the elastic restoring force generated by the bottom plate 418A at the ends in the depth direction of the apparatus. Other effects are the same as those in the first exemplary embodiment.

Although specific exemplary embodiments of the present invention have been described in detail, the present invention is not limited to the above-described exemplary embodiments, and it is obvious to a person skilled in the art that various exemplary embodiments are possible within the scope of the present invention. For example, although the groove-defining portions 118 and 418 are formed in the outer peripheral surfaces 120 of the support members 116 and 416 in the above-described exemplary embodiments, they may instead be formed in the inner peripheral surfaces.

In addition, in the above-described exemplary embodiments, the outer peripheral surface 120 of each of the support members 116 and 416 is in contact with the inner peripheral surface 108A of the cylinder 108 over a region extending in the depth direction of the apparatus. However, the support members 116 and 416 are not limited to this as long as they are in contact with the inner peripheral surface 108A of the cylinder 108 at least at both ends thereof in the depth direction of the apparatus.

Although a single support member 116 or 416 is supported in the cylinder 108 in the above-described exemplary embodiments, two or more support members may instead be supported.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A support member supported in a cylinder included in an image carrier, the support member comprising:

a separation-space-defining portion that is arranged at a certain position in a circumferential direction and extends in an axial direction of the cylinder so that the support member has an arc shape; and a groove-defining portion that extends in the axial direction, wherein an outer diameter of the support member in a central region in the axial direction is smaller than an outer diameter of the support member at both ends in the axial direction, and wherein, in a state in which the support member is supported in the cylinder, the groove-defining portion is elastically deformed such that elastic restoring force generated in the central region is greater than elastic restoring force generated at the ends.

2. The support member according to claim 1, wherein the groove-defining portion has a groove width that is smaller in the central region than at the ends.

3. An image carrier comprising:

a cylinder that has a cylindrical shape and on whose surface a toner image is formed; and the support member according to claim 2 that is supported in the cylinder.

4. An image forming apparatus comprising:

the image carrier according to claim 3;

a charging device that charges the image carrier;

an exposure device that irradiates the charged image carrier with light to form an electrostatic latent image;

a developing device that develops the electrostatic latent image formed on the image carrier into a toner image; and a transfer device that transfers the toner image developed on the image carrier onto a recording medium.

5. The support member according to claim 1, wherein the groove-defining portion has a bottom plate with a plate thickness that is greater in the central region than at the ends.

6. An image carrier comprising:

a cylinder that has a cylindrical shape and on whose surface a toner image is formed; and the support member according to claim 5 that is supported in the cylinder.

7. An image forming apparatus comprising:

the image carrier according to claim 6;

a charging device that charges the image carrier;

an exposure device that irradiates the charged image carrier with light to form an electrostatic latent image;

a developing device that develops the electrostatic latent image formed on the image carrier into a toner image; and a transfer device that transfers the toner image developed on the image carrier onto a recording medium.

8. An image carrier comprising:

a cylinder that has a cylindrical shape and on whose surface a toner image is formed; and the support member according to claim 1 that is supported in the cylinder.

9. An image forming apparatus comprising:

the image carrier according to claim 8;

a charging device that charges the image carrier;

an exposure device that irradiates the charged image carrier with light to form an electrostatic latent image;

a developing device that develops the electrostatic latent image formed on the image carrier into a toner image; and a transfer device that transfers the toner image developed on the image carrier onto a recording medium.

* * * * *